US006547680B1

(12) United States Patent
Marchese, Jr.

(10) Patent No.: US 6,547,680 B1
(45) Date of Patent: Apr. 15, 2003

(54) GREENSPEED MEASUREMENT DEVICE AND METHOD

(76) Inventor: Tom A. Marchese, Jr., 451 Central Ave., Pacific Grove, CA (US) 93940

( * ) Notice: Subject to any disclaimer, the term of this patent is extended or adjusted under 35 U.S.C. 154(b) by 0 days.

(21) Appl. No.: 09/872,943

(22) Filed: Jun. 1, 2001

(51) Int. Cl.[7] ..... A63B 57/00
(52) U.S. Cl. ..... 473/404
(58) Field of Search ..... 473/407, 404, 473/296, 298, 299; 33/313; 81/489

(56) References Cited

U.S. PATENT DOCUMENTS 4,880,232 A * 11/1989 Lang ..... 473/407
4,964,192 A * 10/1990 Marui ..... 81/489
5,524,885 A * 6/1996 Heo ..... 473/299
5,570,884 A * 11/1996 Carps ..... 473/298
5,755,623 A * 5/1998 Mizenko ..... 473/404
6,296,579 B1 * 10/2001 Robinson ..... 473/407

OTHER PUBLICATIONS

USGA Stimpmeter Instruction Booklet, Aug. 2001.

* cited by examiner

*Primary Examiner*—Steven Wong
(74) *Attorney, Agent, or Firm*—Nelson Mullins Riley & Scarborough, L.L.P.

(57) ABSTRACT

A greenspeed measuring device for quick and accurate measurement of the speed of a golf ball on a putting surface. The greenspeed measuring device includes an elongated shaft having a release end and a handle end opposite the release end, the shaft including a bottom side surface and a top side surface. The greenspeed measuring device also includes a ball rolling channel defined in the top side surface that extends from the release end. A ball holding notch is defined in the top side surface adjacent the channel. A handle is attached to the shaft at the handle end and is configured so that the handle end of the shaft can be independently held above a putting surface when the top side surface faces away from the putting surface.

21 Claims, 7 Drawing Sheets

GREENSPEED MEASUREMENT DEVICE AND METHOD

BACKGROUND

The present invention relates to an improved greenspeed measurement device and method for evaluating and testing the speed at which a golf ball will roll on a putting surface.

One of the most significant aspects affecting the enjoyment of play on a golf course is the uniformity of the putting surfaces or greens. Variations in the speed at which a golf ball will roll on the putting surface, whether from one green to the next or on different parts of the same green, can do more to negate a player's skill than can ragged fairways or unkempt bunkers. Most golf course superintendents are well aware of this problem and constantly seek better ways to establish consistent speed on all their greens. The problem they face, however, is extremely complex. There are a host of variables that affect the speed with which a ball rolls on a putting surface. For example, the direction that the grass grows across the green (i.e., the grain), wind, loose impediments on the putting surface, bare spots where grass has died, and more.

Approximately sixty (60) years ago, Edward S. Stimpson, addressed this problem of how to achieve accurate, objective, and statistically valid measurements of the speed of a putting green. The result of his efforts is today known as the Stimpmeter. Mr. Stimpson's device was modified by the United States Golf Association (USGA) technical department in the mid-1970's and made available to golf course superintendents and course officials in 1978.

The Stimpmeter allows one to make a standard measurement of, and place a numerical figure on, the speed of a putting green. It has proven to be an invaluable asset to the game of golf and a helpful management tool for the golf course superintendent.

Referring now to FIGS. 1A, 1B, and 1C the Stimpmeter consists of a flat, extruded aluminum bar 10 that is thirty-six (36) inches long, with a V-shaped groove 12 extending along its entire length. It has a precisely milled and generally rectangular cross-sectional ball-release notch 14 that is thirty (30) inches from a tapered end 16 that rests on the ground or putting surface 18. A notched end 19 is defined opposite tapered end 16. An underside 20 of the tapered end is milled away to reduce bounce as a rolling ball 22 makes contact with the green.

V-shaped groove 12 has an included angle of 145 degrees defined by a respective pair of side surfaces 24 and 26, thereby supporting golf ball 22 at two points 28 and 30 approximately one-half inch apart. A ball 22 rolling down the groove has a slight overspin shown by arrow 32, which is thoroughly consistent and has no deleterious effect on the ensuing measurements. Ball-release notch 14 is designed so that ball 22 will always be released and start to roll when Stimpmeter 10 is raised to an angle of approximately twenty (20) degrees. This design feature is intended to produce a generally constant velocity of the ball when it reaches the tapered end. The device must be raised in a consistent manner to produce this constant velocity. The USGA cautions that even relatively slight damage to release notch 14 or to groove 12 may cause errors in the resultant greenspeed measurement.

To use Stimpmeter 10, the following equipment is needed: Stimpmeter 10; three golf balls; three tees; a measuring tape (not shown); and one data sheet (not shown). First, the operator or greenspeed measurer must select a level area on the green, approximately ten (10) feet by ten (10) feet. One method of checking for a level area is to lay the Stimpmeter on the green and place a ball in V-shaped groove 12, the movement of the ball with indicate whether or not the area is reasonably level. Next, the operator will insert a tee 34 in the green, near the edge of the area selected, to serve as a starting point. The operator then holds Stimpmeter 10 by notched end 19, while the tapered end rests on ground 18 beside tee 34, and aims the Stimpmeter in the direction he or she intends to roll ball 22. A ball 22 is set in notch 14 and notched end 19 is raised slowly until the ball starts to roll down groove 12. It is important that the operator hold Stimpmeter 10 steady until ball 22 reaches the putting surface 18 to obtain an accurate greenspeed measurement. The operator then repeats the same procedure with two more balls, keeping tapered end 16 on the same spot. All three balls 22 should come to rest not more than eight (8) inches apart. Should balls 22 be farther apart than that, the Stimpmeter may have moved too much during the series of rolls, the balls may be damaged or of inferior quality, or other unusual conditions may exist. A pattern larger than eight (8) inches is of questionable accuracy, and the three-roll series should be repeated, perhaps on a different area of putting surface 18.

Assuming balls 22 stop within the prescribed eight (8) inch limit, the measurer then inserts a second tee 34' in the green at the average stopping point of the first series of rolls. The distance $S_1$ between the two tees is the length of the first series of rolls. The measurer then repeats the procedure above using second tee 34' as a starting point and aim balls 22 back toward first tee 34, thus rolling the second series of three balls 22 along roughly the same line, but in the opposite direction. If the second series of balls come to rest within eight (8) inches, the length of the second series of rolls is established. The operator measures the two distances, for each of the first series and the second series, and calculates their average. This average distance is the speed of the green or "Stimpmeter reading."

Should the difference in length between the first and second series be greater than eighteen (18) inches, the accuracy of the resulting average may be questionable. The area selected for the test may not have been sufficiently level, or sufficiently representative of the green, in which case it is advisable to select another area and repeat the test. Sometimes a green may be so severely undulating or sloping that a level area is simply not available. This should be indicated by the resultant data record.

It is important to select a reasonably level test area. Measurements taken up or down a slope, or over mounds, will result in misleading data. Conditions during the Stimpmeter reading or test are also important. Initially, greens should be tested under optimum conditions, a cleanly mowed, dry, smooth surface on a calm day. Once this basic speed is established, speeds and variances can be documented from tests under unusual conditions: windy days, wet surfaces, non-mowed, recently topdressed, time of day, and before and after fertilizer applications. The accumulated data should lead to a better understanding of how different management practices affect the speed and consistency of each green on the golf course.

A relatively small amount of practice in using the Stimpmeter generally increases the accuracy and consistency of the data. It is also important to keep thorough records. Complete and accurate records, maintained over extended periods, are the most useful to the greenskeeping staff. Once the Stimpmeter is put into use at a course and the resulting information is analyzed and acted upon, the possibilities for improved playing conditions are virtually endless.

The above described prior art device and procedure measures only the speed at which a golf ball will roll on a level surface. To get the true feel of the speed at which a golf ball will roll across the putting surface at that greenspeed, it is also generally necessary to putt a few balls toward a present pin position or hole location, as well as other prospective or future hole locations. By making a putt toward a target, one obtains a feel for exactly what the player will experience in attempting to putt to a prospective hole location at the particular greenspeed. Another reason that it is imperative to roll a few putts is that the golf ball leaving the Stimpmeter is already rolling, whereas a putted golf ball typically hops, skips, and/or slides across the putting surface for at least the first few inches after being struck by the putter head and prior to beginning to roll across the putting surface.

New greenskeeping and golf course maintenance technology permits greens designed, for example, in the 1970's or 1980's, to accommodate a maximum Stimpmeter reading of nine (9), to now hold a Stimpmeter reading of eleven (11). This can cause a host of problems. For example, at a Stimpmeter reading of nine (9), the hole location could have been almost anywhere on the putting surface or green, but at a Stimpmeter reading of eleven (11), many of the previously utilized hole locations may be too difficult for the golfer to place an "approach" putt close enough to the hole so that he can "two-putt" the hole. This often results in extra time spent on the green by the golfers, slower play, and even a feeling that the game of golf was "unfair."

SUMMARY

The present invention addresses the foregoing concerns, and others, of prior art constructions and methods. The present invention conveniently includes a combination putting head and lifting handle which increases the speed and accuracy of data collection, and also makes reading a green a bit more enjoyable for a greenskeeper and his or her staff. The present invention includes other refinements as well, for example, a ball release notch that is generally correspondingly shaped to the golf ball and others set forth in the detailed description. By incorporating a level and a measuring tape directly onto the device, a solitary unit takes the place of at least four components of a prior art method, which required a Stimpmeter, a level, measuring tape, and a separate putter.

Accordingly, it is an object of the present invention to provide an improved greenspeed measuring device.

It is a more particular object of the present invention to reduce the number of components that must be gathered to obtain efficient and accurate reading of the green's speed.

It is a still further object of the present invention to provide an improved method of determining the greenspeed and thus the challenge that golfers will experience when they attempt to "hole" their putts from various positions on the green.

It is another object of the present invention to provide the golf course superintendent with the tools to quickly set the difficulty of playing conditions (i.e., hole locations) according to the level of skill expected for a particular day and thus also control and manage the speed of play.

Some of these objects are achieved by a greenspeed measuring device for quick and accurate measurement of the speed at which a golf ball will roll over a putting surface. The greenspeed measuring device includes an elongated shaft having a release end and a handle end opposite the release end, a bottom side surface and a top side surface. A ball rolling channel defined in the top side extends from the release end toward the handle end. A notch is defined in the top side adjacent the channel. The notch is closer to the handle end than the release end. A handle is attached to the shaft at the handle end.

In one exemplary embodiment, the handle is configured so that the handle end of the shaft can be independently held above a putting surface when the top side surface faces away from the putting surface. The handle may include a putter head. The handle may be configured so that when the channel faces away from the putting surface, the handle extends radially from the shaft to hold the handle end of the shaft above the putting surface. The elongate shaft may include a generally circular cross section in the bottom side surface and a V-shaped cut-out in the top side surface. In one preferred embodiment, the channel defines an angle of 144 degrees between a pair of respective side channel surfaces. A level may be affixed to the bottom side surface, and a tape measure may be fastened to the release end. In one preferred embodiment, the bottom side surface defines a tapered surface at the release end such that the channel terminates approximately 0.0313 inches above the release end tapered surface. The handle may include a grippable portion extending generally transverse to a longitudinal axis of the elongate shaft, and the notch, in one preferred embodiment, is generally correspondingly shaped to receive a round golf ball. In one preferred embodiment, the handle is configured to facilitate a one-step three-point grip, wherein an operator's index and middle fingers are approximately one inch apart from each other.

Still further objects of the present invention are achieved by a method of determining a numeric designation of a green's speed and testing the speed of a putting surface. The method includes the steps of: (a) providing a greenspeed measuring device having an elongated shaft, the shaft having a release end and a handle end opposite the release end, the shaft including a bottom side surface and a top side surface, a ball rolling channel extending from the release end toward the handle end, the channel being defined in the top side surface, a notch defined in the top side surface adjacent the channel, and a handle attached to the shaft at the handle end; (b) placing a first golf ball in the notch and slowly raising the handle end away from the putting surface while maintaining the release end in contact with the putting surface until the golf ball moves out of the notch into the channel and rolls down the channel toward the release end and onto the putting surface; (c) repeating step (b) at least two more times; (d) measuring the average distance that the golf balls rolled on the putting surface from the point at which the release end was in contact with the putting surface; (e) repeating the above steps (b)–(d) from the general area which the first the golf ball came to rest so that a second set of golf balls is caused to roll generally in the opposite direction on the putting surface; and (f) measuring an average distance of the second set of golf balls and calculating the average distance the balls rolled in each direction.

In one preferred embodiment of the preferred method, the method includes the step of utilizing the handle end of the greenspeed measuring device to strike a ball on a green to simulate at least one putt to a selected target on the putting surface. The method may also include the step of first selecting a flat area of the putting surface, and the use of three golf balls are rolled and measured in each direction. The method may include the use of a level mounted to the bottom side surface of the elongated shaft to find a flat area of the putting surface. In one preferred method, the step of test-putting to a selected target includes putting to an existing hole location or a prospective hole location, and the handle end includes a heel-toe weighted putter head. In one preferred embodiment of the present method, the step of slowly raising the handle end away from the putting surface includes the use of a three-point grip on the handle.

Still further objects are achieved by a greenspeed measuring device for quick and accurate measurement of the speed at which a golf ball will roll over a putting surface. The greenspeed measuring device includes an elongated shaft defining a longitudinal axis therethrough, the shaft having a release end and a handle end opposite the release end. A ball rolling channel is defined parallel to the longitudinal axis and extends from the release end toward the handle end. A ball holding notch, at least a portion of which is radially displaced from the longitudinal axis is defined adjacent the channel. The device also includes means for gripping the handle end of the elongated shaft.

In one preferred embodiment, the means for gripping includes a handle mounted to the handle end, and at least a portion of the handle extends radially outward from the longitudinal axis a distance of at least one inch. The means for gripping may include a putter head.

Still further objects are achieved by a greenspeed measuring device for quick and accurate measurement of the speed at which a golf ball will roll over a putting surface, the greenspeed measuring device includes an elongated shaft defining a longitudinal axis therethrough, the shaft having a release end and a handle end opposite the release end, a bottom side surface and a top side surface. The bottom side surface defines a tapered surface at the release end. A generally V-shaped ball rolling channel is defined parallel to the longitudinal axis and extends from the release end toward the handle end. A ball holding notch that is generally correspondingly shaped to receive a round golf ball is defined adjacent the channel and at least a portion of the notch is radially displaced from the longitudinal axis. A heel-toe weighted putter head is mounted to the elongated shaft at the handle end to facilitate one-step gripping and raising of the handle end of the device. In one preferred embodiment, the device includes a level mounted to the bottom side surface and a tape measure fastened to the release end.

The accompanying drawings, which are incorporated in and constitute a part of this specification, illustrate one or more embodiments of the invention and, together with the description, serve to explain the principles of the invention.

Figure 1B:
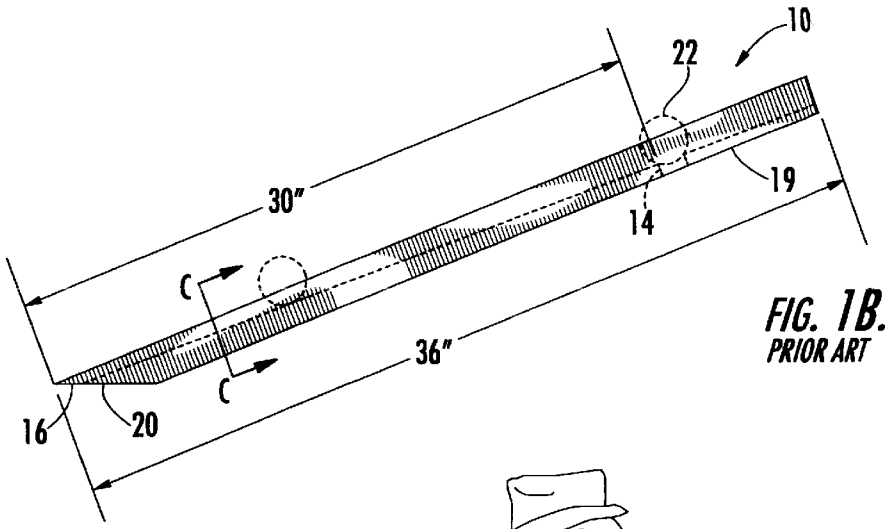
FIG. 1B. PRIOR ART
FIG. 1B is a detailed side view of the Stimpmeter device of FIG. 1A.
Figure 1C:
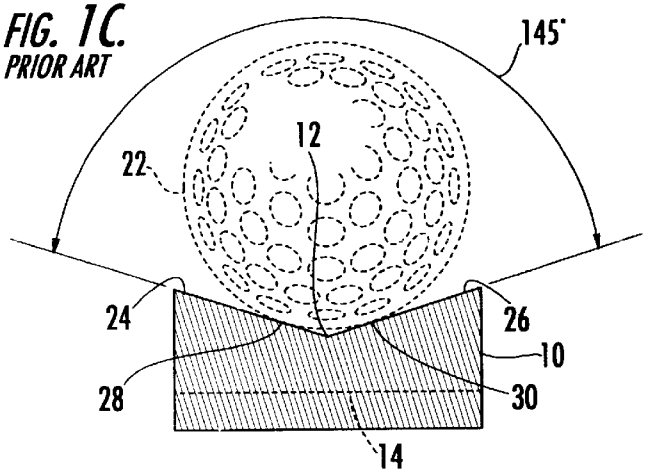
FIG. 1C. PRIOR ART
FIG. 1C is a cross-sectional view taken along lines B—B of FIG. 1B.
Figure 1A:
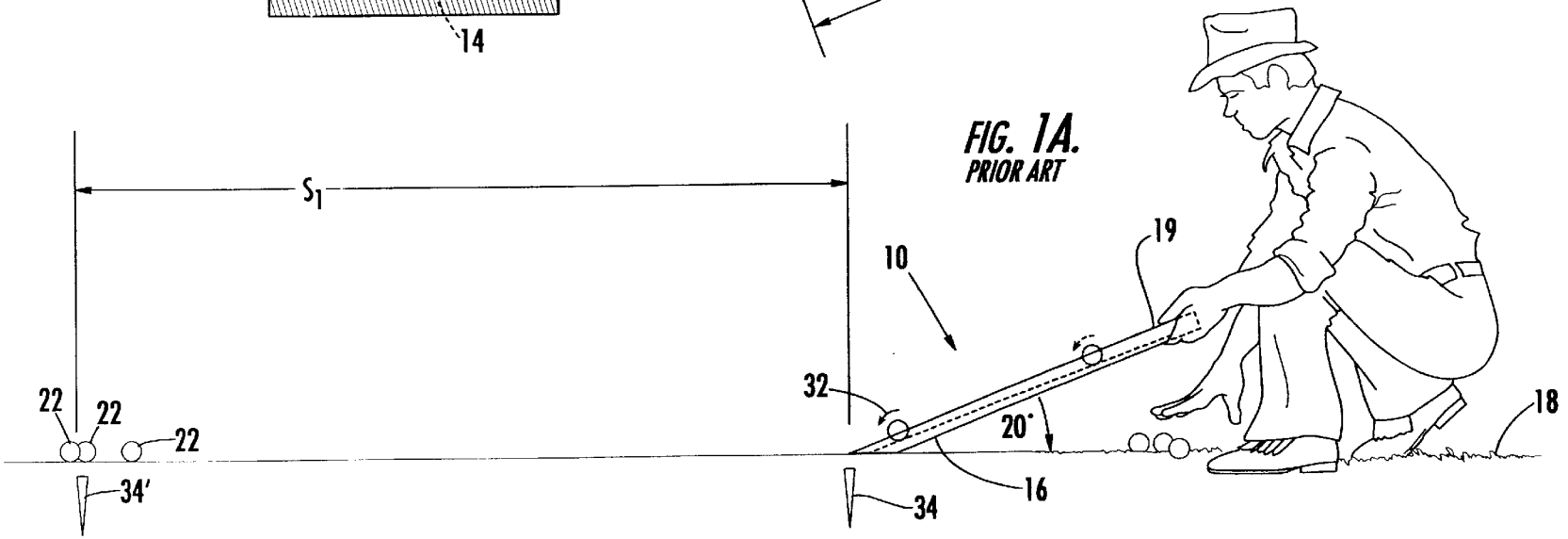
FIG. 1A. PRIOR ART
FIG. 1A is a side view of the prior art Stimpmeter in use on a putting surface.

Repeat use of reference characters in the present specification and drawings is intended to represent same or analogous features or elements of the invention.

DETAILED DESCRIPTION

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

Figure 2A:
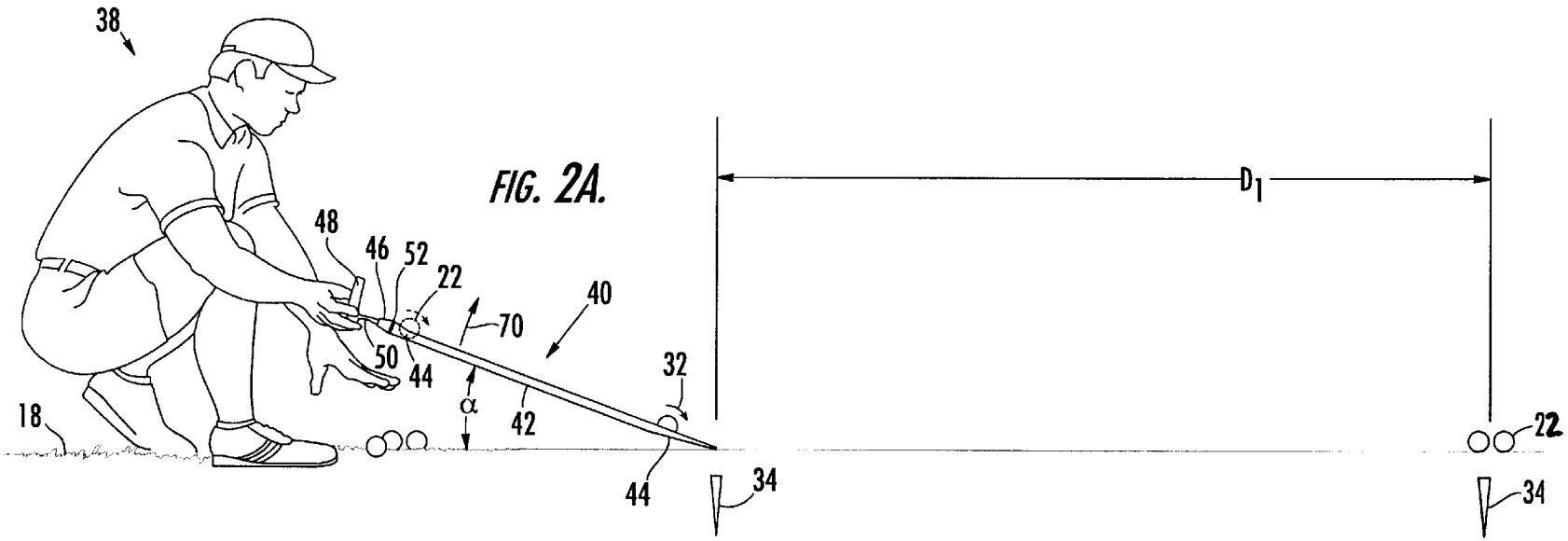
FIG. 2A is a side view of an embodiment of the present invention; a method of use of the present invention.
Figure 7:
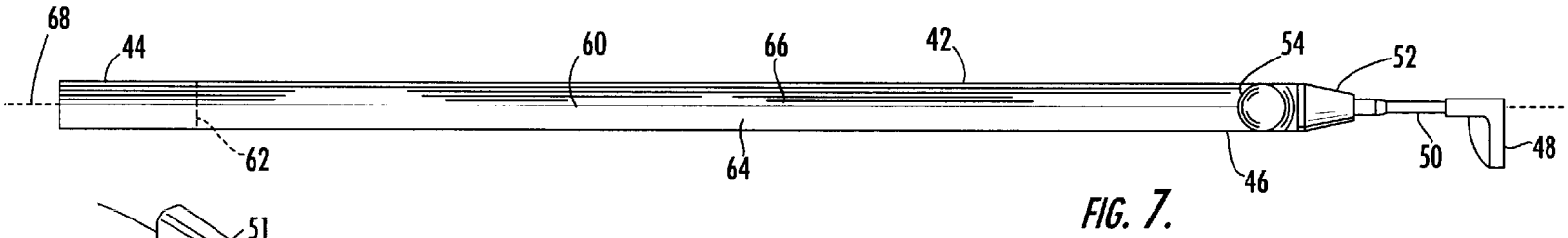
FIG. 7 is an overhead view of the device of FIG. 2A.

Referring to FIG. 2A, an operator or greenspeed measurer 38 utilizing a "Marchese-meter™" 40 in accordance with a preferred embodiment of the present-invention is illustrated. Marchese-meter™ 40 includes an elongated shaft 42 having a tapered end 44 that rests on ground surface 18 and a handle end 46. A combination lifting and test-putting handle 48 is mounted to handle end 46 so that handle 48 extends in a generally transverse direction about separate sides of an axis defined through elongated shaft 42 (FIG. 7). In this preferred embodiment, handle 48 consists of a heel-toe weighted or Ping® type putter head that is mounted to handle end 46 via a hosel 50. Handle end 46 of elongated shaft 42 defines a converging or frusto-conical section 52 that receives hosel 50. A ball holding notch 54 is defined in elongated shaft 42 proximate frusto-conical section 52.

As will be described in more detail below, a golf ball 22 rolls out of ball holding notch 54 at a pre-determined angle of elongated shaft 42 with respect to a horizontal axis, and rolls down elongated shaft 42 towards putting surface 18 with overspin 32. Golf tees 34 and 34' are used by operator 38 to measure the respective distances that a series of balls 22 roll on putting surface 18. In one preferred embodiment of the present invention, a ball 22 will roll out of notch 54 when the elongated shaft 42 defines an angle alpha that is approximately 22 degrees with respect to a horizontal plane. Elongated shaft 42 is preferably of an extruded aluminum construction, but could be constructed of other suitable materials.

Figure 2B:
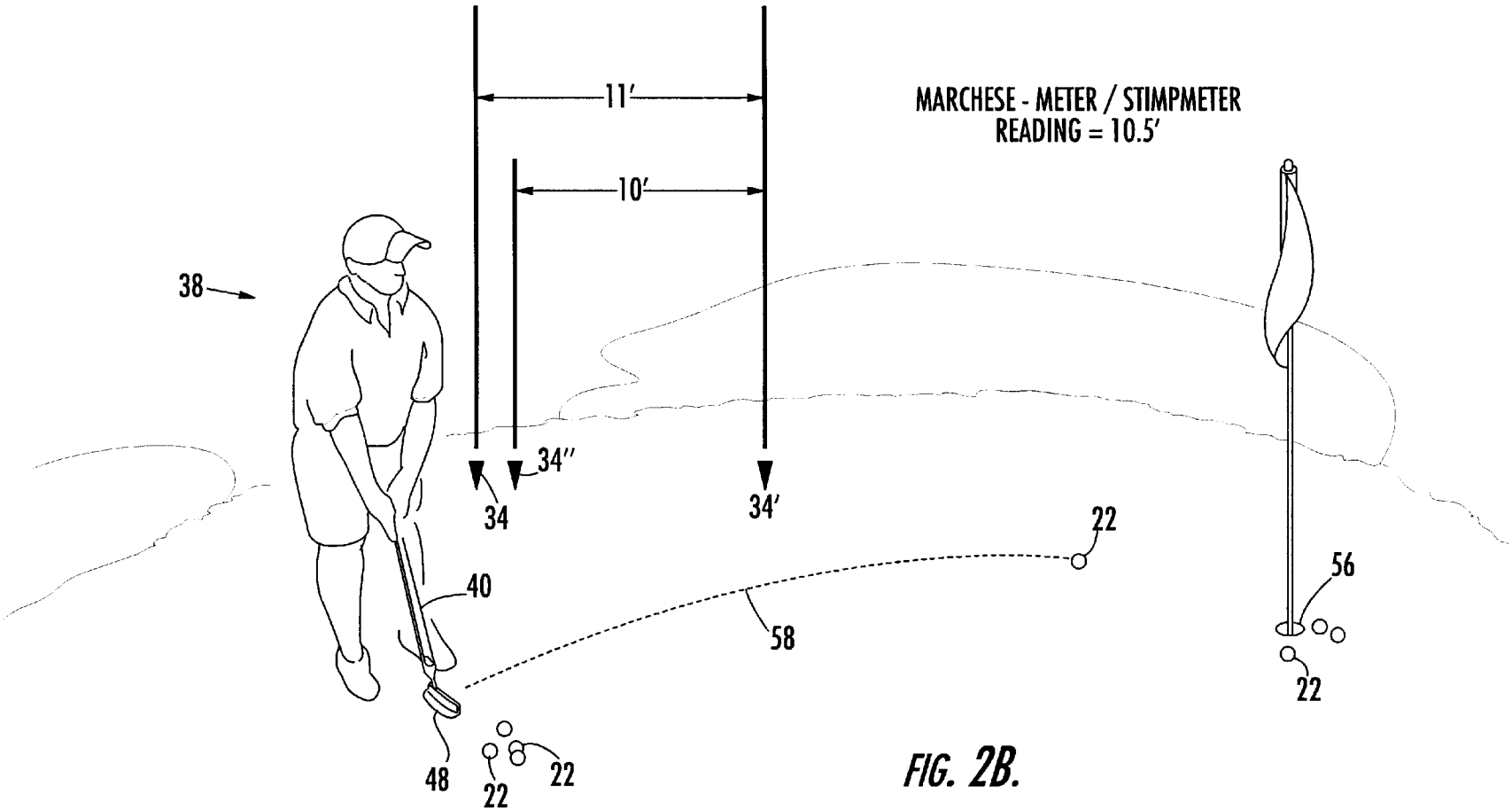
FIG. 2B is a perspective view of a greenspeed measurer or operator "test putting" to a hole location in accordance with a method of use of the present invention.

Referring now also to FIG. 2B, operator or greenspeed measurer 38 is shown utilizing Marchese-meter 40 to "test-putt" a golf ball 22 toward a prospective hole location 56 along a path 58. Just behind operator 38, golf tees 34, 34' and 34" show the results of a prior Stimpmeter or Marchese-meter™ reading (described in more detail below.) FIG. 2B shows operator 38 test-putting a ball towards an actual hole location 56. It should be understood; however, that operator 38 could, after completing the Marchese-meter™ reading, select any number of prospective hole locations and mark such locations with a golf tee 34 or other object, and test-putt a golf ball 22 to that prospective hole location to determine if the particular hole location would be an appropriate test of a golfer's skill, or if such hole location is "unfair" and might result in slow play or other undesirable consequences.

Figures 3, 4:
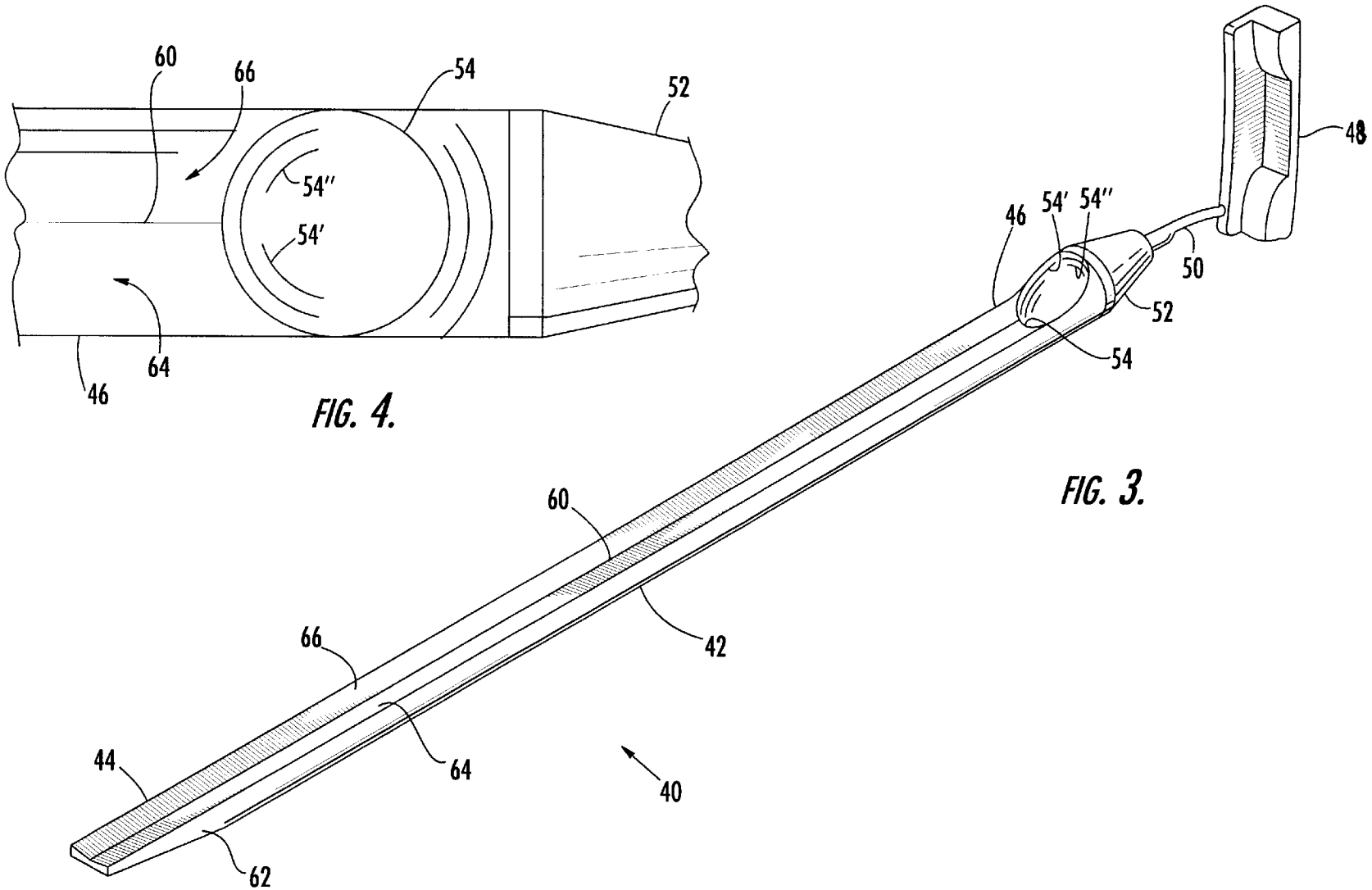
FIG. 3 is perspective view of the device of FIG. 2A.
FIG. 4 is a partial overhead view of the device of FIG. 2A.

Referring now to FIG. 3, Marchese-meter 40 defines a precisely milled V-shaped groove 60 extending along a top side of elongated shaft 42 from ball release notch 54 to tapered end 44. Tapered end 44 defines a tapered section 62 on an opposite side of elongated shaft 42 from V-shaped groove 60. In a preferred embodiment of the present invention, tapered section 62 is milled from tapered end 44 so that a golf ball 22 rolling down V-shaped groove 60 will be released in a consistent manner from the V-shaped groove 60 to produce accurate data regarding greenspeed. Thus, tapered section 62 of elongated shaft 42 creates an interface between putting surface 18 and Marchese-meter™ 40.

FIG. 4 illustrates a close-up view of ball release notch 54 of the present invention. As shown, V-shaped groove 60 includes two planar side surfaces 64 and 66 indicated by reference numbers 54' and 54", and ball release notch 54 is designed to be generally correspondingly shaped to a golf ball 22, thus holding ball 22 securely within ball release notch 54 during operation and use of the Marchese meter™. This "snug" fitting design of ball release notch 54 increases "side-to-side" stability of a golf ball 22 within notch 54 and thus produces more accurate and reliable results.

Figure 5:
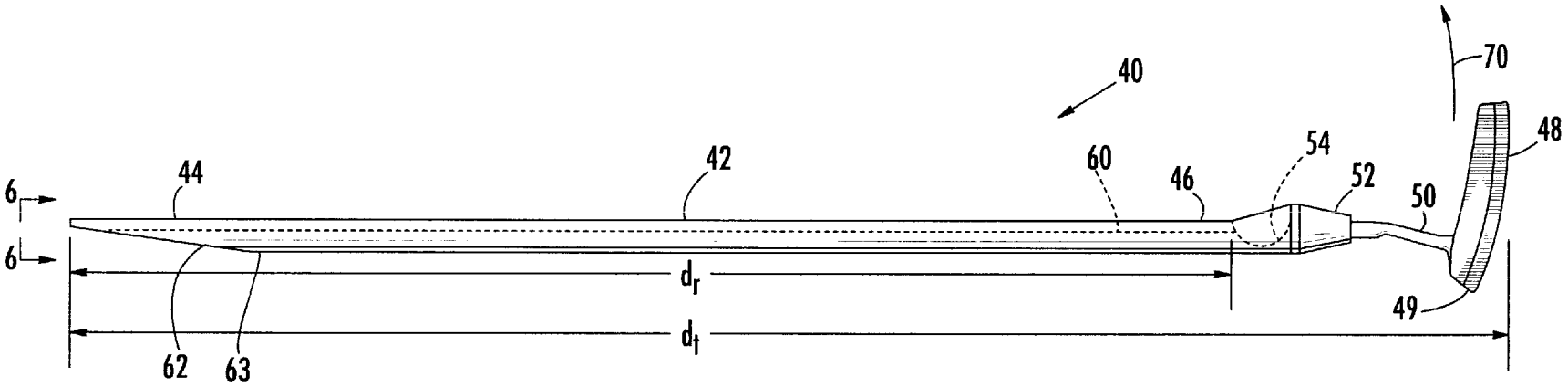
FIG. 5 is a plan view of the device of FIG. 2A.

As shown in FIG. 5, Marchese-meter™ 40 includes elongated shaft 42 and handle 48. Hosel 50 of handle 48 may be slightly offset from an axis 68 of elongated shaft 42 (FIG. 7). Accordingly, a heel end 49 of handle 48 may be milled slightly so that Marchese-meter 40 will independently stand upright on a putting surface, as tapered section 62 and heel end 49 each define generally parallel planar surfaces for resting the Marcheses-meter™ on putting surface 18. This feature enables operator 38 to readily and steadily grasp handle 48 and raise it upward in direction 70 to roll a golf ball 22 out of ball release notch 54, down V-shaped groove 60, off tapered end 44 and onto putting surface 18 to obtain a quick and accurate Marchese-meter™ reading. The inclusion of handle 48 in the Marchese-meter™ is particularly useful when conditions require the operator to wear gloves, for example, in cold weather, during chemical use, or the like. In one preferred embodiment of the present invention, the distance between the heel end 49 and the toe end (opposite the heel end) of the putter head is approximately five (5) inches.

Figure 10:
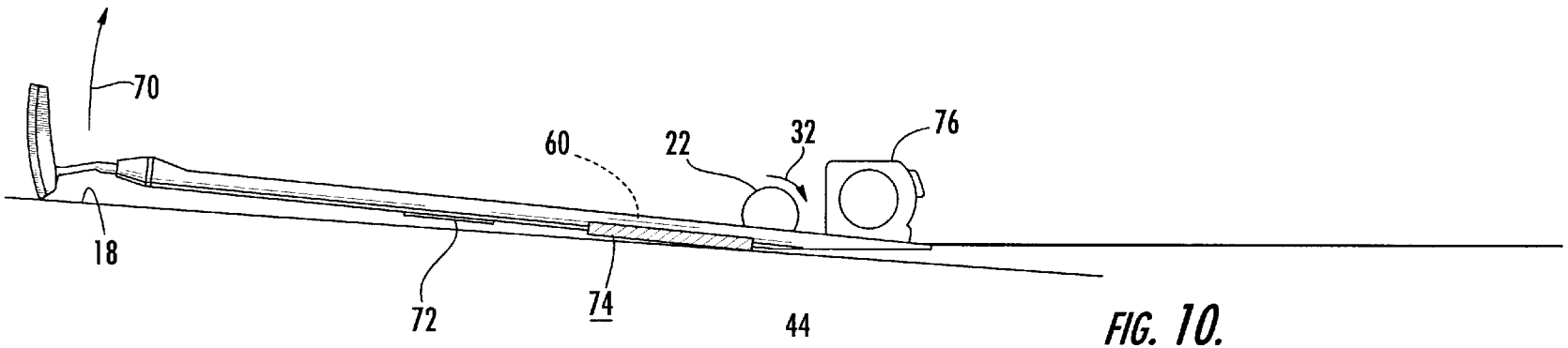
FIG. 10 is a side view of the device of FIG. 2A including a tape measure and a grip.

It should be understood that tapered section 62 may define several different planar surfaces to facilitate Marchese-meter 40 independently sitting upright on putting surface 18 and to further facilitate stability of the device during use. The bottom-side portion of elongated shaft 42 that contacts putting surface 18 when Marchese-meter 40 is independently held upright in a gripping position may include handle grip section 74 (FIG. 10). V-shaped groove 60 defines a distance $d_r$ along the topside surface of elongated shaft 42 that is approximately 29.125 inches in one preferred embodiment. The total length $d_t$ of Marchese-meter 40, in one preferred embodiment, is approximately 36 inches. It should be understood, however, that the total length and/or other dimensions of Marchese-meter 40 may vary depending on a variety of factors. It should be understood that other putter heads could be included on Marchese-meter™ to create alternative embodiments. For example, a "Bulls-Eye®" type putter head or the like could be utilized to accommodate the particular preference of operator 38 and further to accommodate a particular putting surface.

Figure 6:
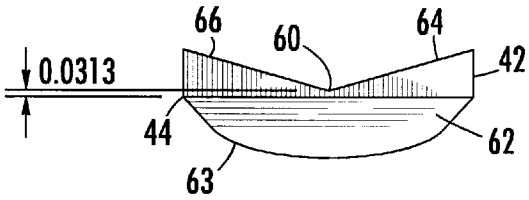
FIG. 6 is an end view of a portion of the device of FIG. 5 taken along lines 6—6.

As shown in the preferred embodiment illustrated in FIG. 6, V-shaped groove 60 terminates at tapered end 44 at a distance of approximately 0.0313 inches from termination of tapered section 62. Side surfaces 64 and 66 define an angle of approximately 144 degrees.

As shown in the embodiment illustrated in FIG. 7, hosel 50 of handle 48 extends generally along a plane that coincides with an axis 68 of elongated shaft 42. This represents a non-offset embodiment. As described above, offset embodiments are within the scope and spirit of the present invention, as are alternative type putter heads, and/or alternative dimensional configurations. It should be understood that heel end 49 of any particular putter head utilized as grip 48 in the present invention may be altered and/or modified to facilitate Marchese-meter 40 independently sitting in the upright position on putting surface 18 for example, if a "Bulls-Eye®" type putter head is utilized on a Marchese-meter™, then an added component may be necessary to stabilize the device as it will rest independently in the upright position on putting surface 18.

Figure 8:
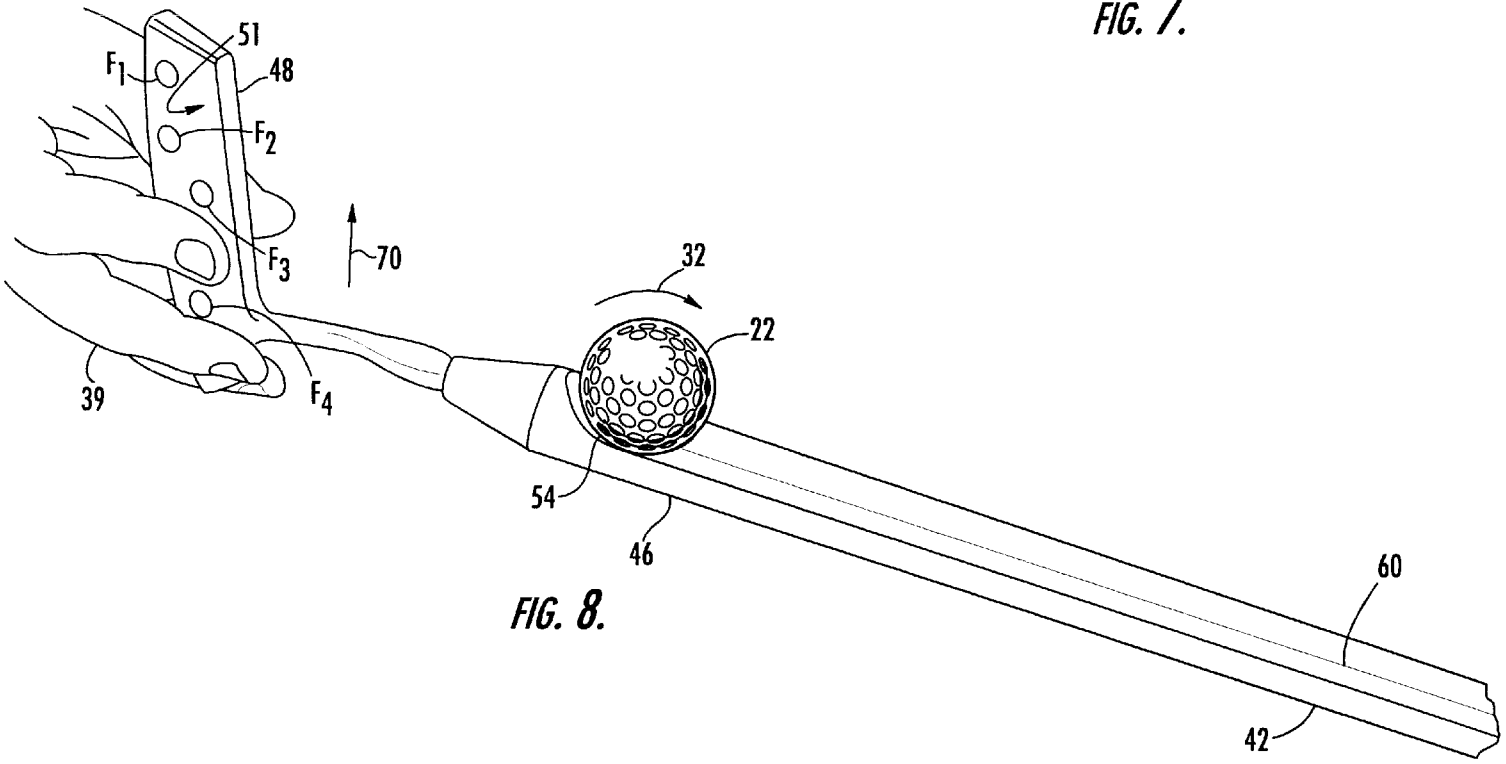
FIG. 8 is a perspective view of the device of FIG. 2A showing an operator holding the handle end in accordance with the present invention; [three finger grip]

As shown in FIG. 8, a gripping hand 39 of operator 38 can readily grasp handle 48 in a three point position and quickly and steadily raise handle end in direction 70 to cause ball 22 to roll out of ball release notch 54, down V-shaped groove 60, and onto putting surface 18 for a quick and accurate Marchese-meter™ reading. Additionally, while a three point grip is illustrated, it should be understood that other types of grips are available by the inclusion of handle 48 on Marchese-meter™ 40. For example, operator 38 could place all four fingers on a putting face 51 of handle 40, while also utilizing his or her thumb on the opposite side surface of handle 48 to quickly, and steadily raise handle end 46 in direction 70. One embodiment of the four fingered position on putter face surface 51 is shown at reference points $F_1$–$F_4$. Additionally, it should be understood that generally the same four fingers and/or positions could be in contact with the opposite side surface and the thumb could be in contact with surface 51.

Figure 9:
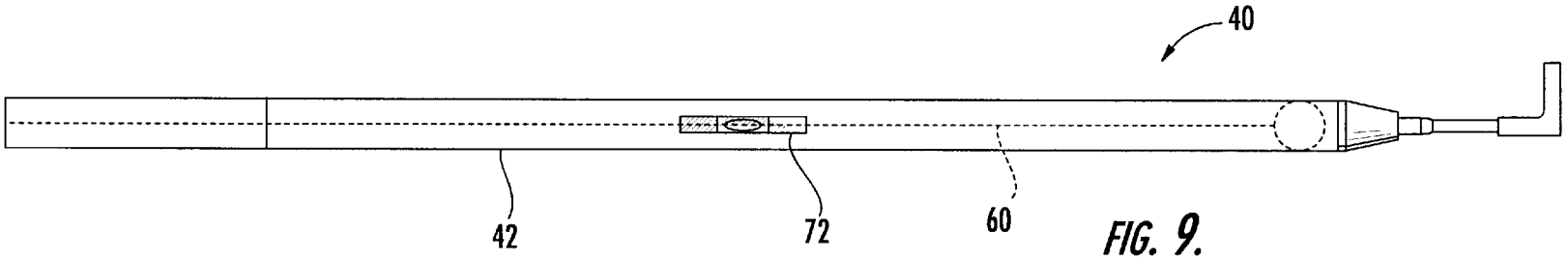
FIG. 9 is a bottom view of the device of FIG. 2A with a level included.

As shown in FIG. 9, a standard construction type fluid and air bubble level 72 may be mounted on elongated shaft 42 opposite V-shaped groove 60 to assist operator 38 in quickly locating a level spot on the putting surface 18 on which to obtain the Marchese-meter™ reading.

As shown in FIG. 10, the present invention also contemplates the use of a grip 74 mounted to the opposite side surface of V-shaped groove 60 to give operator 38 "added feel" when striking a test-putt. Tapered end 44 may include a side mount (not shown) configured to releaseably hold a tape measure 76. Of course, the side mount and tape measure 76 must be configured so as to not interfere with a golf ball 22 rolling down V-shaped groove 60.

The method of utilizing the Marchese-meter™ to obtain a greenspeed measurement is similar to that of the Stimpmeter. In fact, because golf course superintendents, golfers, USGA officials, and others throughout the world are already familiar with the Stimpmeter reading scale, the Marchese-meter™ has been designed to produce an identical reading to the Stimpmeter, but does so more quickly, more accurately, more conveniently, and further enables virtually instantaneous test-putting to prospective hole locations. It should be understood, however, that other scales could be developed.

Referring again to FIG. 2A, operator 38 is shown utilizing Marchese-meter™ 40. First, the operator or greenspeed measurer 38 must select a level area on the green, approximately ten (10) feet by ten (10) feet. One method of checking for a level area is to lay the Marchese-meter™ on the green and view the fluid and air construction type level.

Once a level area is found, operator 38 will insert a tee 34 in the green 18, near an edge of the area selected, to serve as a starting point. The operator then holds Marchese-meter™ 40 by handle 48, while tapered end 44 rests on ground 18 beside tee 34, and aims the Marchese-meter™ in the direction he or she intends to roll ball 22. A ball 22 is set in ball holding notch 54 and handle end 46 is raised slowly in direction 70 (pivoting generally about tapered end 44) until the ball starts to roll down groove 60. Transverse-extending gripping handle 48 permits operator 38 to hold Marchese-meter™ 40 steady throughout the procedure until ball 22 reaches the putting surface 18 to obtain an accurate greenspeed measurement. The operator then repeats the same procedure with two more balls, keeping tapered end 44 on roughly the same spot. All three balls 22 should come to rest not more than eight (8) inches apart. Should balls 22 be farther apart than that, the device may have moved too much during the series of rolls, the balls may be damaged or of inferior quality, or other unusual conditions may exist. However, experience in use indicates a much higher reliability of the resultant data when compared to the prior art Stimpmeter. A pattern larger than eight (8) inches is of questionable accuracy, and the three-roll series should be repeated, perhaps on a different area of putting surface 18.

Assuming balls 22 rolled from Marchese-meter™ 40 stop within the prescribed eight (8) inch limit, the measurer then inserts a second tee 34' in the green at the average stopping point of the first series of rolls. The distance $D_1$ between the two tees is the length of the first series of rolls. The measurer then repeats the procedure above using second tee 34' as a starting point and aims balls 22 back toward first tee 34, thus rolling the second series of three balls 22 along roughly the same line, but in the opposite direction. If the second series of balls come to rest within eight (8) inches, the length of the second series of rolls is established. The operator measures the two distances, one for each of the first series and the second series, and calculates their average. This average distance is the speed of the green or "Marchese-meter™ reading."

If the difference in length between the first and second series of rolls is greater than eighteen (18) inches, the accuracy of the resulting average may be questionable. The area selected for the test may not have been sufficiently level, or sufficiently representative of the green, in which case it is advisable to select another area and repeat the test. This should be indicated by the resultant data record.

Golf course maintenance personnel can now use the accumulated data to better understand and readily obtain and document how different management practices affect the speed and consistency of each green on the golf course. The Marchese-meter™ is easy to use to produce accurate and consistent data.

The above described use of the Marchese-meter™ to quickly and accurately obtain a numeric representation of the speed of the green is only the first step. To get the true feel of the speed at which a golf ball will roll across the putting surface at that greenspeed, it is also generally necessary to putt a few balls toward a present pin position or hole location, as well as other prospective or future hole locations. By making a putt toward a target, one obtains a feel for exactly what the player will experience in attempting to putt to a prospective hole location at the particular greenspeed. To address this need, the Marchese-meter™ conveniently provides a combination lifting handle and test-putting head 48.

Referring now again to FIG. 2B, operator 38 is shown "test putting" to pin or hole 56. Also illustrated in the background of FIG. 2B are the three tees 34, 34', and 34" representing the results of a previous Marchese-meter reading of 10.5 feet (e.g., roll number one averaged eleven (11) feet and roll number two (i.e. the opposite direction) averaged ten (10) feet). Thus operator 38 knows that the Marchese-meter reading for this green is "10.5 feet," and can use that numeric designation to gather data on appropriate hole locations at that greenspeed. The operator can also document other conditions such as weather, wind, moisture in the greens and other factors to begin to create a data record for this green under varying conditions. Because the Marchese-meter™ is a solitary unit, it can be quickly used by one (or many) greenskeeping personnel to accumulate an invaluable knowledge-base to assist them in managing the course for a variety of events ranging from a Club Championship, a PGA-event, a pro-Am, a ladies morning tournament, a tuff day, a junior event, or a Friday afternoon dog-fight. By developing and maintaining this data, the superintendent can make quick and effective decisions regarding course set up and management without even being physically present at the golf course. The Marchese-meter™ makes the development of this data easier and more enjoyable, thus raising the likelihood that it will be collected.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore it is contemplated that any and all such embodiments are included in the present invention as may fall within the literal and equivalent scope of the appended claims.

What is claimed is:

1. A greenspeed measuring device for quick and accurate measurement of the speed at which a golf ball will roll over a putting surface, said greenspeed measuring device comprising:

an elongated shaft, said shaft having a release end and a handle end opposite said release end, said shaft including a bottom side surface and a top side surface;

a ball rolling channel extending from said release end toward said handle end, said channel defined in said top side surface;

a notch defined in said top side surface adjacent said channel, said notch being defined closer to said handle end than said release end; and a handle attached to said shaft at said handle end, said handle including a putter head.

2. The device as in claim 1, wherein said handle is configured so that said handle end of said shaft can be independently held above a putting surface when said top side surface faces away from the putting surface.

3. The device as in claim 1, wherein when said channel faces away from the putting surface, said handle extends radially from said shaft to hold said handle end of said shaft above the putting surface.

4. The device as in claim 1, wherein said shaft defines a generally circular cross section in said bottom side surface and said top side surface channel includes a V-shaped cut-out.

5. The device as in claim 1, wherein said channel defines an angle of 144 degrees between a pair of respective side channel surfaces.

6. The device as in claim 1, including a level affixed to said bottom side surface.

7. The device as in claim 1, including a tape measure fastened to said release end.

8. The device as in claim 1, wherein said bottom side surface defines a tapered surface at said release end so that said channel terminates approximately 0.0313 inches above said release end tapered surface.

9. The device as in claim 1, wherein said handle includes a grippable portion extending generally transverse to a longitudinal axis of said elongate shaft.

10. The device as in claim 1, wherein said notch is generally correspondingly shaped to receive a round golf ball.

11. The device as in claim 1, wherein said handle is configured to facilitate a one-step three-point grip, wherein an operator's index and middle fingers are approximately one inch apart from each other.

12. A method of determining a numeric designation of a green's speed and testing the speed of a putting surface, said method comprising the steps of:

(a) providing a greenspeed measuring device having an elongated shaft, said shaft having a release end and a handle end opposite said release end, said shaft including a bottom side surface and a top side surface, a ball rolling channel extending from said release end toward said handle end, said channel being defined in said top side surface, a notch defined in said top side surface adjacent said channel, and a handle attached to said shaft at said handle end;

(b) Placing a first golf ball in said notch and slowly raising said handle end away from the putting surface while maintaining said release end in contact with the putting surface until said golf ball moves out of said notch into said channel and rolls down said channel toward said release end and onto the putting surface;

(c) Repeating step (b) at least two more times;

(d) Measuring the average distance that said golf balls rolled on the putting surface from the point at which said release end was in contact with the putting surface;

(e) Repeating the above steps (b)–(d) from the general area which the first said golf ball came to rest so that a second set of golf balls is caused to roll generally in the opposite direction on the putting surface;

(f) Measuring an average distance of the second set of golf balls and calculating the average distance said balls rolled in each direction; and (g) Utilizing said handle end of said greenspeed measuring device to strike a ball on a green to simulate at least one putt to a selected target on the putting surface.

13. The method as in claim 12, including the step of first selecting a flat area of the putting surface, and wherein three said golf balls are rolled and measured in each direction.

14. The method as in claim 13, including utilizing a level mounted to said bottom side surface of elongated shaft to find a flat area of the putting surface.

15. The method as in claim 12, wherein said target includes an existing hole location or a prospective hole location, and wherein said handle end includes a heel-toe weighted putter head.

16. The method of claim 12, wherein said step of slowly raising said handle end away from the putting surface includes the use of a three-point grip on said handle.

17. A greenspeed measuring device for quick and accurate measurement of the speed at which a golf ball will roll over a putting surface, said greenspeed measuring device comprising:

an elongated shaft defining a longitudinal axis therethrough, said shaft having a release end and a handle end opposite said release end;

a ball rolling channel defined parallel to said longitudinal axis and extending from said release end toward said handle end;

a ball holding notch, wherein at least a portion of said notch is radially displaced from said longitudinal axis, said notch being adjacent said channel; and means for gripping said handle and of said elongated shaft, said means for gripping including a putter head.

18. The device as in claim 17, wherein said means for gripping includes a handle mounted to said handle end, and wherein at least a portion of said handle extends radially outward from said longitudinal axis a distance of at least one inch.

19. A greenspeed measuring device for quick and accurate measurement of the speed at which a golf ball will roll over a putting surface, said greenspeed measuring device comprising:

an elongated shaft defining a longitudinal axis therethrough, said shaft having a release end and a handle end opposite said release end, a bottom side surface and a top side surface, and wherein said bottom side surface defines a tapered surface at said release end;

a generally V-shaped ball rolling channel defined parallel to said longitudinal axis and extending from said release end toward said handle end;

a ball holding notch adjacent said channel, wherein at least a portion of said notch is radially displaced from said longitudinal axis, wherein said ball holding notch is generally correspondingly shaped to receive a round golf ball; and a heel-toe weighted putter head mounted to said elongated shaft at said handle end to facilitate one-step gripping and raising of said handle end of said device.

20. The device as in claim 19, including a level mounted to said bottom side surface; and a tape measure fastened to said release end.

21. A method of determining a numeric designation of a green's speed and testing the speed of a putting surface, said method comprising the steps of:

(a) Providing a greenspeed measuring device having an elongated shaft, said shaft having a release end and a handle end opposite said release end, said shaft including a bottom side surface and a top side surface, a ball rolling channel extending from said release end toward said handle end, said channel being defined in said top side surface, a notch defined in said top side surface adjacent said channel, and a handle attached to said shaft at said handle end;

(b) Placing a first golf ball in said notch and slowly raising said handle end away from the putting surface while maintaining said release end in contact with the putting surface until said golf ball moves out of said notch into said channel and rolls down said channel toward said release end and onto the putting surface;

(c) Repeating step (b) at least two more times;

(d) Measuring the average distance that said golf balls rolled on the putting surface from the point at which said release end was in contact with the putting surface;

(e) Repeating the above steps (b)–(d) from the general area which the first said golf ball came to rest so that a second set of golf balls is caused to roll generally in the opposite direction on the putting surface; and (f) Measuring an average distance of the second set of golf balls and calculating the average distance said balls rolled in each direction, wherein said target includes an existing hole location or a prospective hole location, and wherein said handle end includes a heel-toe weighted putter head.

* * * * *